US010731822B2

(12) United States Patent
He et al.

(10) Patent No.: US 10,731,822 B2
(45) Date of Patent: Aug. 4, 2020

(54) LIGHT-EMITTING DEVICE FOR MOTOR VEHICLE

(71) Applicant: Foshan Ichikoh Valeo Auto Lighting Systems Co., Ltd, Foshan (CN)

(72) Inventors: Yongjian-Mike He, Foshan (CN); Zhilin-Jones Su, Foshan (CN); Steven Shi, Foshan (CN); Jason Deng, Foshan (CN); Jerome Monnot, Foshan (CN)

(73) Assignee: Foshan Ichikoh Valeo Auto Lighting Systems Co., Ltd, Foshan (CN)

( * ) Notice: Subject to any disclaimer, the term of this patent is extended or adjusted under 35 U.S.C. 154(b) by 0 days.

(21) Appl. No.: 15/983,695

(22) Filed: May 18, 2018

(65) Prior Publication Data

US 2018/0335194 A1 Nov. 22, 2018

(30) Foreign Application Priority Data

May 19, 2017 (CN) ..... 2017 1 0356434

(51) Int. Cl.
*F21S 43/245* (2018.01)
*F21S 43/27* (2018.01)
(Continued)

(52) U.S. Cl.
CPC ..... *F21S 43/245* (2018.01); *F21S 41/143* (2018.01); *F21S 41/24* (2018.01); *F21S 41/25* (2018.01);
(Continued)

(58) Field of Classification Search
CPC ..... F21S 43/245; F21S 41/24; F21S 43/247; F21S 41/25; F21S 43/14; F21S 43/27;
(Continued)

(56) References Cited

U.S. PATENT DOCUMENTS 8,764,256 B2 * 7/2014 Foote ..... B60R 1/12 362/494
2008/0186726 A1 * 8/2008 Okada ..... B60Q 1/0041 362/509
(Continued)

FOREIGN PATENT DOCUMENTS

EP 0 584 545 A1 3/1994
EP 1 557 605 A2 7/2005
(Continued)

OTHER PUBLICATIONS

Search Report dated Sep. 27, 2018 in European Patent Application No. 18 17 2488, 2 pages.

*Primary Examiner* — Britt D Hanley
*Assistant Examiner* — Jessica M Apenteng
(74) *Attorney, Agent, or Firm* — Oblon, McClelland, Maier & Neustadt, L.L.P.

(57) ABSTRACT

A light-emitting device for a motor vehicle, including a housing and a light source assembly arranged in the housing, wherein the light-emitting device further includes a substantially plate-shaped light guide including an opening portion, and the light guide is positioned in such a way that the light source assembly is located behind the opening portion in a main emitting direction of the light-emitting device or located in the center of the opening portion, thereby transmitting lateral light from the light source assembly into the light guide. According to the light-emitting device of the present invention, the light rays from the light source assembly are expanded through the light guide, and can be used to display a decorative pattern, thereby providing more lighting decorative design styles and improving the aesthetic appearance.

14 Claims, 3 Drawing Sheets

(51) Int. Cl.

| | |
|---|---|
| ***F21S 41/29*** | (2018.01) |
| ***F21S 41/24*** | (2018.01) |
| ***F21S 43/241*** | (2018.01) |
| ***F21S 43/247*** | (2018.01) |
| ***F21S 41/143*** | (2018.01) |
| ***F21S 43/14*** | (2018.01) |
| ***F21S 41/25*** | (2018.01) |
| ***F21S 43/239*** | (2018.01) |

(52) U.S. Cl.
CPC ..... *F21S 41/29* (2018.01); *F21S 43/14* (2018.01); *F21S 43/239* (2018.01); *F21S 43/241* (2018.01); *F21S 43/247* (2018.01); *F21S 43/27* (2018.01)

(58) Field of Classification Search
CPC ..... F21S 41/143; F21S 43/239; F21S 41/29; F21S 43/241
USPC ..... 362/511
See application file for complete search history.

(56) References Cited

U.S. PATENT DOCUMENTS

2010/0157587 A1* 6/2010 Isoda ..... G02B 6/0021 362/231
2013/0039083 A1* 2/2013 Gong ..... B60R 13/10 362/511

FOREIGN PATENT DOCUMENTS

| | | |
|---|---|---|
| EP | 1 826 475 A1 | 8/2007 |
| FR | 2 890 917 A1 | 3/2007 |
| JP | 2011-222377 | 11/2011 |

* cited by examiner

LIGHT-EMITTING DEVICE FOR MOTOR VEHICLE

BACKGROUND

Technical Field

The present invention relates to a technical field of vehicle device, and more particularly, to a light-emitting device for a motor vehicle.

Description of the Related Art

A motor vehicle is provided with a lighting and/or signaling device for providing lighting and/or signaling functions. The lighting and/or signaling device is also referred to as a light-emitting device, including a headlight, a fog light, a tail light, a turn light indicator, a stop light, a parking light, and so on. In the motor vehicle, the light-emitting device is generally of a reflective design, thus a light source is directly visualized and thereby aesthetic effect is affected, and the light emitted by the light source is dazzling.

In addition, in the prior art, the light-emitting device is generally only used as an independent functional module. For example, a front fog light is only used as a fog light. Moreover, in the conventional light-emitting devices for the vehicle, there is no light-emitting device capable of displaying a special decorative figure or pattern (for example, a vehicle LOGO pattern). In order to provide a decorative effect, it is known to add a decorative ring around the light-emitting device. However, it still cannot satisfy the need for more lighting decorative design styles.

SUMMARY

In order to at least partially overcome the drawbacks in the prior art, the present invention provides a light-emitting device for a motor vehicle with expanded functions.

The present invention is further intended to provide a light-emitting device for a motor vehicle capable of displaying a decorative figure or pattern.

The present invention is still intended to provide a light-emitting device for a motor vehicle that enriches the lighting decorative design styles and improves the aesthetic appearance.

In order to achieve at least one of the above objectives, technical solutions of the present invention are provided as follows:

A light-emitting device for a motor vehicle, comprising a housing and a light source assembly arranged in the housing, wherein the light-emitting device further comprises a substantially plate-shaped light guide comprising an opening portion, and the light guide is positioned in such a way that the light source assembly is located behind the opening portion in a main emitting direction of the light-emitting device or located in the center of the opening portion, thereby transmitting lateral light from the light source assembly into the light guide.

According to a preferable embodiment of the present invention, the light guide is of a substantially quadrilateral, and a notch is provided at a side of the light guide in vicinity of the opening portion, the notch having a triangular shape, and boundary faces are formed at corners of the light guide.

According to a preferable embodiment of the present invention, the light guide comprises a display portion configured to allow the light transmitted into the light guide to exit.

According to a preferable embodiment of the present invention, the display portion comprises a plurality of tapered grooves, which are uniformly distributed.

According to a preferable embodiment of the present invention, the display portion comprises a pattern consisting of a plurality of tapered grooves.

According to a preferable embodiment of the present invention, the light-emitting device further comprises a lens, which is located at a front of the light guide in the main emitting direction of the light-emitting device and corresponds to the opening portion and the display portion.

According to a preferable embodiment of the present invention, the light-emitting device further comprises a front panel provided with opening zones where the opening portion and the display portion are located.

According to a preferable embodiment of the present invention, a fixing support is provided on the housing.

According to a preferable embodiment of the present invention, fixing holes are provided in the corners of the light guide.

According to a preferable embodiment of the present invention, the thickness of the corners is less than that of a main body of the light guide, so as to form a plurality of steps.

According to a preferable embodiment of the present invention, the light-emitting device is constructed to be a fog light, a headlamp or a tail light.

According to the present invention, the main light rays emitted from the light source assembly are emitted out through the lens and the opening zone of the front panel serving as a main function of the light-emitting device, for example, providing a lighting and/or signaling function. Meanwhile, the lateral light rays emitted from the light source assembly enter the light guide, the light rays are totally reflected in the light guide and propagate in the light guide, so that the light rays are spread to surrounding zones of the light source assembly, for example, an upper portion and a lower portion, and are emitted out from the display portion. Such portion of the light rays increases the function of the light-emitting device, for example, such light rays can enrich the lighting decorative design style, and improve the aesthetic appearance of the light-emitting device of the vehicle. Further, a pattern such as a vehicle LOGO can also be constructed on the display portion so that the pattern can be displayed when the light-emitting device operates.

It should be noted that, a uniform radiative lighting effect can be formed on the display portion by the tapered grooves. The tapered grooves herein belong to a kind of microstructure, and therefore it is possible to form various patterns by designing the layout of the tapered grooves. For example, if the tapered grooves are arranged in a line, then it can achieve a linear lighting effect. Similarly, other patterns or characters can be achieved.

It can be seen that, by using the design of light guide and microstructure, the present invention satisfies the requirements for style diversity, and enriches the lighting design style. Moreover, the lighting and/or signaling function shares the functional light-emitting module with the decorative function without additional light source, thus it reduces the cost, and it can simultaneously meet the requirements on the vehicle style and the regulation for the lighting and/or signaling device. In the market, the light rays of the light-emitting device are not directed into the surrounding zones, for example, the upper and lower zones. As for the design for luminous decoration, there is no design of generating a style shape or a LOGO of the vehicle by the light emitted from the microstructure.

DETAILED DESCRIPTION OF PREFERRED EMBODIMENTS

Figure 1:
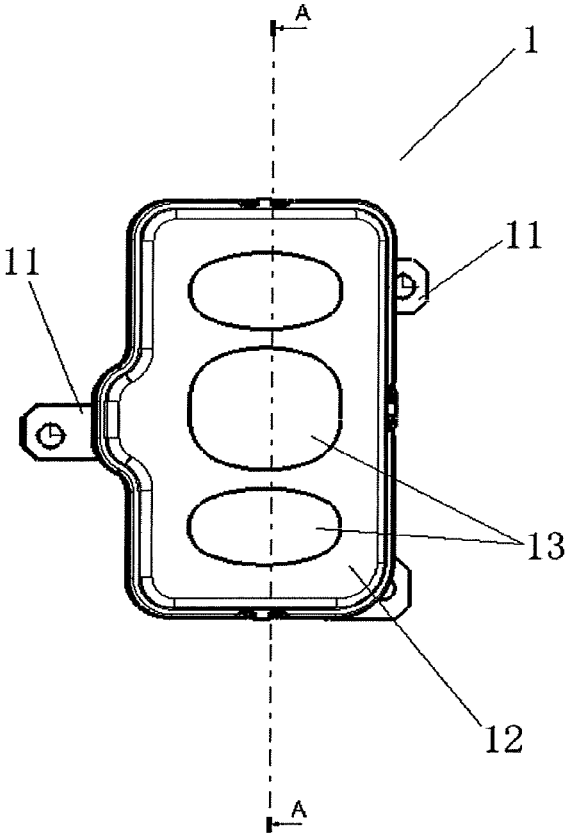
FIG. 1 is a front view of a light-emitting device for a motor vehicle according to an embodiment of the present invention.

Exemplary embodiments of the present invention will be described in detail below with reference to the accompanying drawings in which the same or similar reference numerals represent the same or similar elements. In addition, in the following detailed description, numerous specific details are set forth in order to facilitate the explanation and provide a thorough understanding of the embodiments of the present disclosure. However, it will be apparent that the embodiment(s) may also be practiced without these specific details. In other cases, well-known structures and devices are schematically illustrated to simplify the drawings.

According to a general inventive concept of the present invention, there is provided a light-emitting device 1 for a motor vehicle, including a housing 16 and a light source assembly 15 arranged in the housing 16, wherein the light-emitting device 1 further includes a substantially plate-shaped light guide 14 including an opening portion 144, and the light guide 14 is positioned in such a way that the light source assembly 15 is located behind the opening portion 144 in a main emitting direction of the light-emitting device 1 or located in the center of the opening portion 144, thereby transmitting lateral light from the light source assembly 15 into the light guide 14. Herein, the main emitting direction is referred to a direction pointing to the left side of FIG. 2.

Figure 2:
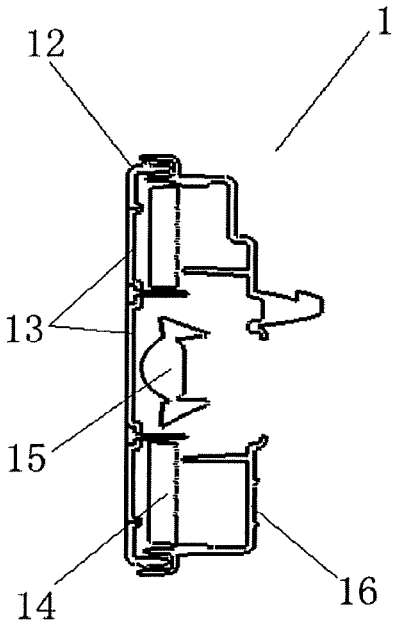
FIG. 2 is a cross-sectional view of the light-emitting device for the motor vehicle taken along a line A-A in FIG. 1.
Figure 3:
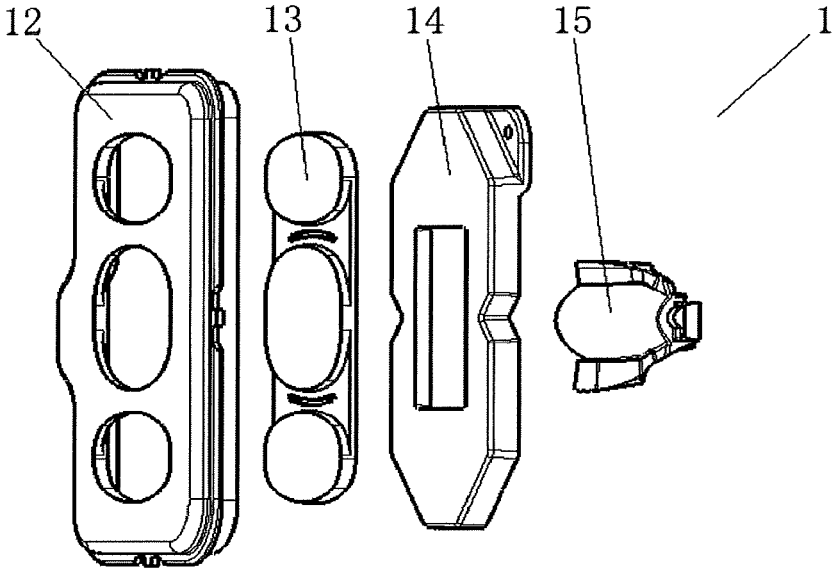
FIG. 3 is an exploded view of a light-emitting device for a motor vehicle according to an embodiment of the present invention.

Specific embodiments of the present invention will be described in detail below with reference to the accompanying drawings. FIGS. 1-3 illustrate a structure of a light-emitting device for a motor vehicle according to an embodiment of the present invention. The light-emitting device 1 is constructed to include a housing 16, a light source assembly 15, a light guide 14, a lens 13 and a front panel 12. A fixing support 11 is provided on the housing 16 for fixing the light-emitting device 1 to the vehicle. As shown in the figures, there are three fixing supports 11 in the illustrated embodiment, which are formed on a back side of the housing 16 in a triangular configuration, to achieve a stable support. Further, screw holes are provided on the fixing support. The light source assembly 15 is disposed in the housing 16 and can be fixed in any suitable manner, and the light guide 14 is fixed to the housing 16. The light guide 14 is substantially plate-shaped and includes an opening portion 144 (see FIG. 5), and the light guide 14 is positioned in such a way that the light source assembly 15 is located behind the opening portion 144 in a main emitting direction of the light-emitting device 1 or located in the center of the opening portion 144, thereby transmitting lateral light from the light source assembly 15 into the light guide 14. That is to say, the light source assembly 15 may be disposed within the opening portion 144 or disposed slightly rearward near the opening portion 144. In this way, a portion of the light rays emitted by the light source assembly 15 (for example, laterally scattered light rays) may enter the light guide from edges of the opening portion 144, and the light guide 14 does not affect the propagation of the main light rays of the light source assembly 15, and therefore the light guide 14 does not affect the main function of the light-emitting device the lighting and/or signaling function. After the light rays enter the light guide 14, they will propagate in the plate-shaped light guide, thus it is equivalent to expanding the light rays emitted by the light source assembly 15 to the surrounding zones, for example upper and lower zones in this embodiment, referring to the structure of the light guide in FIG. 5 for details.

Figure 5:
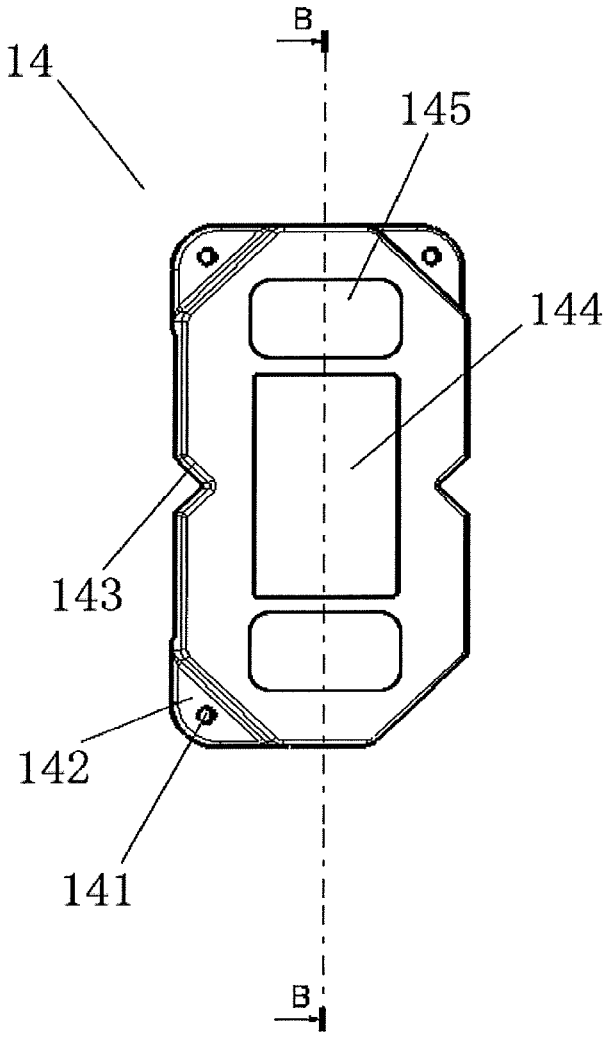
FIG. 5 is a front view of a light guide in a light-emitting device for a motor vehicle according to an embodiment of the present invention.

Preferably, the light guide 14 includes display portions 145 configured to allow the light transmitted into the light guide 14 to exit (see FIG. 5). The display portions 145 may be located around the opening portion 144, for example, above the opening portion 144 and below the opening portion 144, thereby to form an upper display portion and a lower display portion. With the display portion 145, if the light rays are transmitted to the display portion, then the display portion can emit light. The specific structure of the display portion will be described below.

As for the light source assembly 15, it may be a LED-type light source including an LED, a printed circuit board, and an inner lens. The lens 13 may be located in front of the light guide 14 in the main emitting direction of the light-emitting device 1 and correspond to the opening portion 144 and the display portions 145. In the embodiment, the lens 13 is an integrally-formed lens and includes three regions, i.e., a region corresponding to the opening portion, a region corresponding to the upper display portion and a region corresponding to the lower display portion. The lens 13 is not necessarily an integrally-formed lens, and may include three sub-lenses, i.e., an intermediate lens corresponding to the opening portion of the light guide, an upper lens corresponding to the upper display portion of the light guide and a lower lens corresponding to the lower display portion of the light guide.

The front panel 12 is coupled with the housing 16 by a snap fit, so that the light guide 14 and the light source assembly 15 are enclosed within the housing 16, and the lens 13 can be fixed on the front panel 12. The front panel 12 is provided with opening zones where the opening portion 144 and the display portions 145 are located. In case that the lens 13 is composed of three sub-lenses, the three sub-lenses are respectively embedded in one opening zone.

Figure 4:
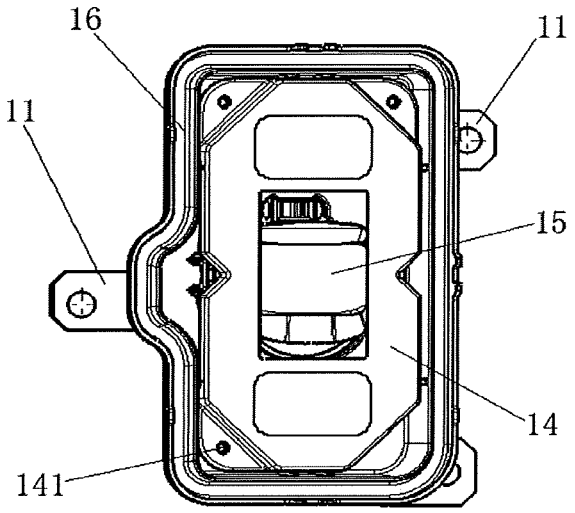
FIG. 4 is a front view of a light-emitting device for a motor vehicle according to an embodiment of the present invention, in which a front panel and a lens are removed.

FIG. 4 is a front view of a light-emitting device for a motor vehicle according to an embodiment of the present invention, in which the front panel and the lens are removed. FIG. 4 shows the fixation of the light guide 14 within the housing 16, specifically, fixing holes 141 are provided in the corners 142 of the light guide 14. The fixing holes 141 and the screws are used to fix the light guide 14 to the housing 16.

Figure 6:
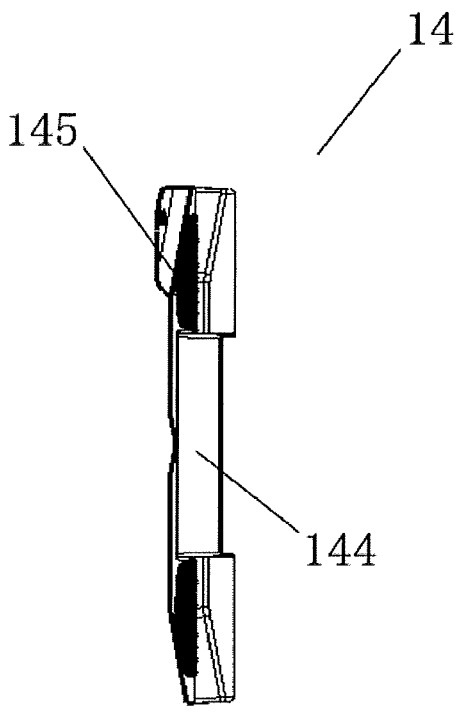
FIG. 6 is a cross-sectional view of the light guide taken along a line B-B in FIG. 5.

The structure of the light guide 14 is described in detail below. As shown in FIGS. 5-6, the light guide 14 is constructed to be substantially plate-shaped (i.e., having four sides), in the center of which the opening portion 144 is located, and the display portions 145 are located above and below the opening portion 144. A notch 143 is provided at one side of the light guide 14 in vicinity of the opening portion 144. The notch 143 is triangular, and boundary faces are formed at corners 142 of the light guide 14, and fixing holes 141 are provided in the corners 142 of the light guide 14. The term "substantially plate-shaped" herein is generally referred to being generally quadrangular, rather than in a strict sense. The light guide is made of a transparent PC or PMMA material.

Preferably, the thickness of the corners 142 is less than that of a main body of the light guide 14, so as to form a plurality of steps, thereby forming the boundary faces between the corners and the main body of the light guide. The boundary faces can be considered as a surface on which the light rays can be reflected in the light guide.

Figure 7:
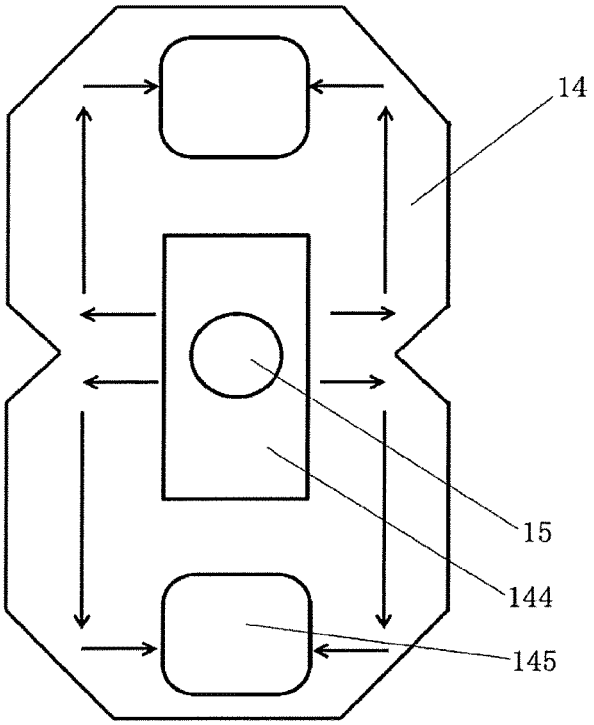
FIG. 7 is a schematic view showing a propagation optical path in the light guide.

With the above structure, the light rays from the light source assembly 15 can enter the light guide and undergo total reflection within the light guide. For example, referring to FIG. 7 which is a schematic view showing a propagation optical path in the light guide, the lateral light rays emitted from the light source assembly 15 enter the light guide through the edges of the opening portion 144, and are reflected at the notch of the light guide, and the reflected light rays are reflected again at the boundary faces and are directed into the display portion 145.

Figure 8:
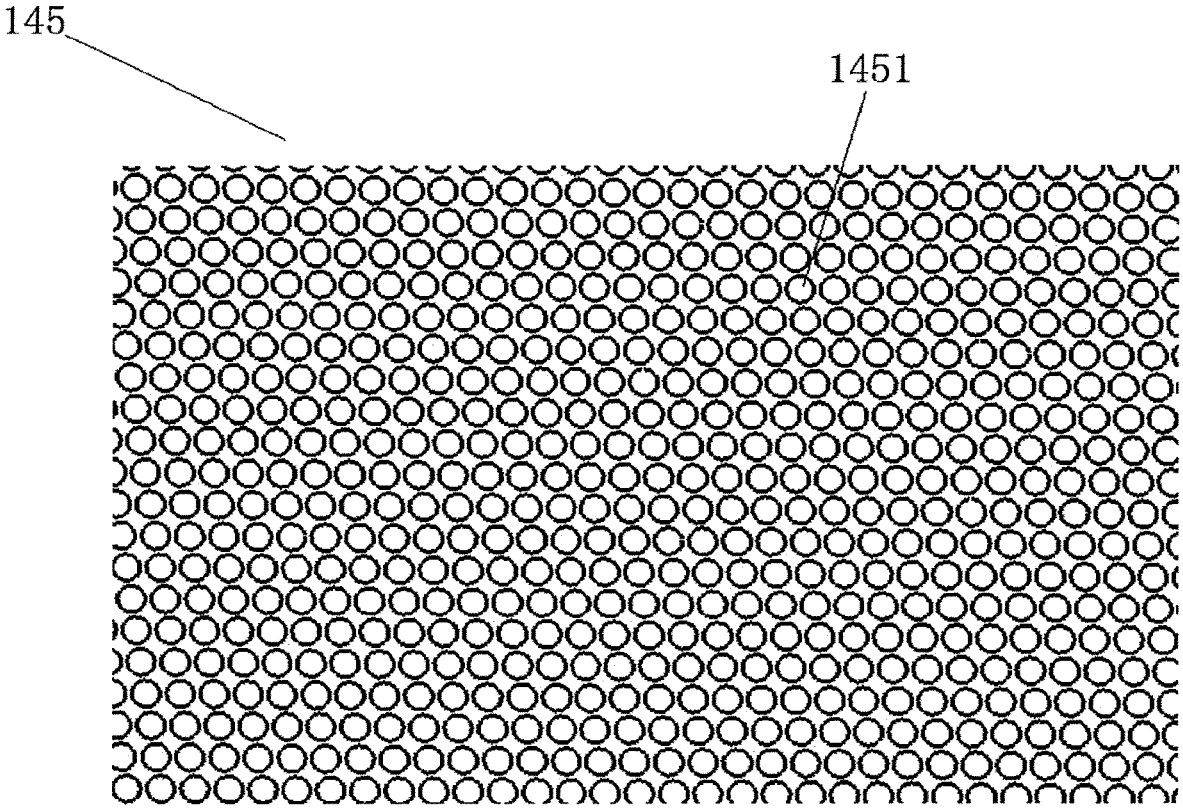
FIG. 8 shows a microstructure of a display portion of a light guide.

In the embodiment shown in FIG. 8, the display portion 145 is constructed to be composed of a plurality of tapered grooves 1451, which are uniformly distributed. Herein, the display portion 145 may be integrally formed with the light guide 14, and they are made of the same materials. As shown in FIG. 8, the tapered grooves 1451 are regularly arranged on the display portion 145, and the tapered grooves 1451 open towards the housing 16. The display portion 145 may also be constructed to have a pattern formed by the combination of the tapered grooves 1451, for example, the tapered grooves are arranged in a line.

The light-emitting device 1 according to the present invention can be constructed to be a fog light, a headlamp or a tail light, and the light rays generated thereby are not dazzling.

According to the present invention, the main light rays emitted from the light source assembly are emitted out through the lens and the opening zone of the front panel serving as a main function of the light-emitting device, for example, providing a lighting and/or signaling function. Meanwhile, the lateral light rays emitted from the light source assembly enter the light guide, the light rays are totally reflected in the light guide and propagate in the light guide, so that the light rays are spread to surrounding zones of the light source assembly, for example, an upper portion and a lower portion, and are emitted out from the display portion. Such portion of the light rays increases the function of the light-emitting device, for example, such light rays can enrich the lighting decorative design style, and improve the aesthetic appearance of the light-emitting device of the vehicle. Further, a pattern such as a vehicle LOGO can also be constructed on the display portion so that the pattern can be displayed when the light-emitting device operates.

It should be noted that, a uniform radiative lighting effect can be formed on the display portion by the tapered grooves. The tapered grooves herein belong to a kind of microstructure, and therefore it is possible to form various patterns by designing the layout of the tapered grooves. For example, if the tapered grooves are arranged in a line, then it can achieve a linear lighting effect. Similarly, other patterns or characters can be achieved.

It can be seen that, by using the design of light guide and microstructure, the present invention satisfies the requirements for style diversity, and enriches the lighting design style. Moreover, the lighting and/or signaling function shares the functional light-emitting module with the decorative function without additional light source, thus it reduces the cost, and it can simultaneously meet the requirements on the vehicle style and the regulation for the lighting and/or signaling device. In the market, the light rays of the light-emitting device are not directed into the surrounding zones, for example, the upper and lower zones. As for the design for luminous decoration, there is no design of generating a style shape or a LOGO of the vehicle by the light emitted from the microstructure.

In particular, there are three corners 142 in the light guide 14, that is, one corner of the light guide 14 is cut away, as shown in FIG. 5. Advantageously, a light-shielding coating can be applied to outer periphery of the quadrilateral of the light guide in order to avoid light leakage on the sides of the light guide 14. The notch 143 includes two side surfaces with the same area and each side surface has the same area as the boundary face.

In addition, the lens 13 may only include an intermediate lens, which may be integrally formed with the light guide 14, and the opening portion 144 of the light guide 14 may be configured to be covered by the intermediate lens at the top of the opening portion. In this way, it dispenses with an independent component and eliminates the mounting of the lens. In this case, the light guide 14 may not be fixed through the fixing holes, i.e., the fixing holes 141 are not provided. The light guide 14 may be placed in a recess of the housing 16. After the front panel 12 is installed, the light guide 14 is directly clamped between the front panel 12 and the housing 16, thereby the light leakage caused by the openings in the light guide 14 is also avoided, and installation steps are saved up. Further, the light-emitting device according to the present invention further includes a plurality of reflective tapered particles, the number of which is the same as that of the plurality of tapered grooves 1451. In the case that the display portion is configured to include a plurality of tapered grooves 1451 evenly distributed, the plurality of reflective tapered particles may be selectively filled into the tapered grooves 1451, to close the tapered grooves in the display portion. In this way, a user is free to fill the tapered particles into the tapered grooves, utilize the arrangement of the tapered particles to form a specific pattern. When the light-emitting device operates, a recognizable pattern can be generated since the tapered particles refract and reflect light.

While the embodiments of the present invention have been shown and described, variations and modifications may be made to these embodiments by those skilled in the art without departing from the principles and spirit of the present invention. The scope of the present invention is defined by the appended claims and equivalents thereof.

REFERENCE NUMERAL LIST

1 light-emitting device
11 fixing support
12 front panel
13 lens
14 light guide
141 fixing hole
142 corner

143 notch
144 opening portion
145 display portion
1451 tapered groove
15 light source assembly
16 housing

What is claimed is:

1. A light-emitting device for a motor vehicle, comprising: housing; and a light source assembly arranged in the housing;

a substantially plate-shaped light guide comprising an opening portion, and the light guide is positioned in such a way that the light source assembly being positioned behind the opening portion in a main emitting direction of the light-emitting device or located in the center of the opening portion, thereby transmitting lateral light from the light source assembly, into the light guide, wherein the light guide includes a display portion separated from the opening portion and from an edge of the light guide by a portion of the light guide configured to prevent light from exiting, the display portion being configured to allow the lateral light transmitted into the light guide to exit.

2. The light-emitting device according to claim 1, wherein the light guide is of a substantially quadrilateral, and a notch is provided at a side of the light guide in vicinity of the opening portion, the notch having a triangular shape, and boundary faces are formed at corners of the light guide.

3. The light-emitting device according to claim 2, wherein fixing holes are provided in the corners of the light guide.

4. The light-emitting device according to claim 3, wherein the thickness of the corners is less than that of a main body of the light guide, so as to form a plurality of steps.

5. The light-emitting device according to claim wherein a fixing support is provided on the housing.

6. The light-emitting device according to claim 2, wherein the tight-emitting device is constructed to be a fog light, a headlamp or a tail light.

7. The light-emitting device according to claim 1, wherein the display portion comprises a plurality of tapered grooves, which are uniformly distributed.

8. The light-emitting device according to claim 1, wherein the display portion comprises a pattern including a plurality of tapered grooves.

9. The light-emitting device according to claim 8, wherein the pattern corresponds to a logo.

10. The light-emitting device according to claim 1, further comprising a lens, which is located at a front of the light guide in the main emitting direction of the light-emitting device and corresponds to the opening portion and the display portion.

11. The light-emitting device according to claim 10, further comprising a front panel provided with opening zones where the opening portion and the display portion are located.

12. The light-emitting device according to claim 1, wherein a fixing support is provided on the housing.

13. The light-emitting device according to claim 1, wherein the light-emitting device is constructed to be a fog light, a headlamp or a tail light.

14. The light-emitting device according to claim 1, wherein fixing holes are provided in the corners of the light guide.

* * * * *